US009795211B2

(12) United States Patent
Talley

(10) Patent No.: US 9,795,211 B2
(45) Date of Patent: Oct. 24, 2017

(54) GARMENT DYE PEN

(71) Applicant: Belinda Talley, Youngstown, FL (US)

(72) Inventor: Belinda Talley, Youngstown, FL (US)

( * ) Notice: Subject to any disclaimer, the term of this patent is extended or adjusted under 35 U.S.C. 154(b) by 0 days.

(21) Appl. No.: 14/683,331

(22) Filed: Apr. 10, 2015

(65) Prior Publication Data

US 2015/0296971 A1 Oct. 22, 2015

Related U.S. Application Data

(60) Provisional application No. 61/981,380, filed on Apr. 18, 2014.

(51) Int. Cl.
*A46B 17/04* (2006.01)
*A46B 11/00* (2006.01)
*D06P 5/00* (2006.01)

(52) U.S. Cl.
CPC ..... *A46B 11/001* (2013.01); *A46B 11/0089* (2013.01); *D06P 5/00* (2013.01)

(58) Field of Classification Search
CPC ..... A46B 11/001; A46B 11/0089
USPC ..... 401/269
See application file for complete search history.

(56) References Cited

U.S. PATENT DOCUMENTS 3,565,540 A * 2/1971 Andrews ..... A46B 11/0041 401/115
3,628,876 A 12/1971 Casey et al.
4,082,467 A * 4/1978 Kaplan ..... C09D 11/16 106/31.34
5,324,127 A 6/1994 Cortez
6,270,277 B1 * 8/2001 Ogino ..... A46B 11/0013 401/262
6,283,933 B1 9/2001 D'Alessio et al.
6,450,724 B1 * 9/2002 Cambio ..... B43M 11/08 401/183
6,739,779 B1 * 5/2004 Deeds ..... B43K 8/02 222/129
6,832,867 B2 12/2004 Sandbach et al.
6,905,276 B2 * 6/2005 Van Buskirk ..... C11D 17/041 252/187.24
7,976,234 B2 * 7/2011 May ..... B29C 45/0046 222/541.4
8,523,474 B2 * 9/2013 Liu ..... A47K 5/1212 401/175
9,248,690 B2 * 2/2016 Lira-Nunez ..... B43K 23/12
2002/0178511 A1 12/2002 Goldoni et al.
(Continued)

FOREIGN PATENT DOCUMENTS

DE WO 8904620 A1 * 6/1989 ..... A61C 17/036

*Primary Examiner* — Jennifer C Chiang
(74) *Attorney, Agent, or Firm* — Global Intellectual Property Agency, LLC; Daniel Boudwin

(57) ABSTRACT

A garment dye pen for covering relatively isolated bleach marks thereon and a method for using the same. The garment dye pen comprises a tubular housing having a closed distal end and an open proximal end forming a fluid reservoir therein containing liquid dye. The open proximal end includes female threaded elements that align with a cap having aligning male threaded elements. The liquid dye is induced to evacuate the fluid reservoir through a nozzle on the cap. The cap further comprises a pointed tip brush applicator also configured to disperse the liquid dye when placed in contact with a bleach spot on a garment of clothing.

6 Claims, 3 Drawing Sheets

(56) References Cited

U.S. PATENT DOCUMENTS

| | | | | |
|---|---|---|---|---|
| 2010/0293726 | A1* | 11/2010 | Glover | B43K 8/024<br>8/636 |
| 2011/0123253 | A1* | 5/2011 | Matsui | A46B 5/04<br>401/269 |
| 2012/0257921 | A1 | 10/2012 | Diener | |
| 2013/0287475 | A1* | 10/2013 | Tanrikulu | B05C 1/00<br>401/269 |

* cited by examiner

GARMENT DYE PEN

CROSS REFERENCE TO RELATED APPLICATION

This application claims the benefit of U.S. Provisional Application No. 61/981,380 filed on Apr. 18, 2014. The above identified patent application is herein incorporated by reference in its entirety to provide continuity of disclosure.

BACKGROUND OF THE INVENTION

Field of the Invention

The present invention relates to fabric treatment applications. More specifically, the present invention pertains to an improved garment dye pen for relatively isolated bleach marks thereon. The garment dye pen is configured to be placed in contact with a bleach spot on a garment of clothing and disperse liquid dye thereon by the way of an applicator.

It happens to everybody at some point. Bleach gets on a favorite shirt or pants, and there is now an ugly, discolored mark. Can it be fixed? Or does it mean that the article of clothing is ruined forever? However, a bleach mark generally cannot be undone because bleach takes the color out of fabric and cannot be "unbleached." However, there are a couple of remedies that might salvage your item. One type of remedy if bleach has splattered on an article of clothing is to bleach the entire article, and living with whatever new color emerges. However, the effect of bleaching the entire item is unknown.

Another remedy is to mark with a permanent marker if the bleach marks are small and possibly inconspicuous. This technique works best for dark colored items with a permanent marker that most closely matches the color of the article of clothing. However, permanent marker may fade, and markings may need to redone after the next wash. Another method is to dye the entire article of clothing. Many dye packages come with a soda ash solution, which helps the dye to bond with the fabric of the clothing. First, dissolve the soda ash solution into a bowl of water, and then let the clothing soak in it. However, the dying process can still work without soda ash and a shirt can be soaked in lukewarm water. Dying a damp shirt helps the color to travel further, and faster.

However, if the bleached area is concentrated to a limited area, then it may be a better idea to keep the shirt dry. The dye will not spread very far and stay relatively isolated. The present invention provides a garment dye pen for relatively isolated bleach marks on an article of clothing. The garment dye pen comprises a tubular housing having a closed distal end and an open proximal end forming a fluid reservoir therein filled with liquid dye. The open proximal end has female threaded elements that align with a cap having aligning male threaded elements. The cap further comprises a point tip brush applicator that is configured to disperse the liquid dye when placed in contact with a bleach spot on a garment of clothing. After application, the newly dyed garment can be set aside so that the dye has time to react with the cloth. After a period of time, the bleach spot now dyed to substantially match the article of clothing is rinsed to remove any excess dye.

Description of the Prior Art

Devices have been disclosed in the prior art that relate to pen and ink devices, particularly in the area of applicators for fabric treatment. These include devices that have been patented and published in patent application publications. Some devices provide a tubular applicator body with a vial therein in communication with the open end of the tubular applicator body. Another devices provide a removably attached applicator head, a tubular container body and fluid therein, wherein the applicator head further includes a distribution body such as brush bristles. These devices, however, do not provide an applicator with a pointed tip brush to apply colored liquid dye to faded, stained, or bleached garments and fabrics. The foregoing is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 6,832,867 to Sandbach is a fabric treatment applicator providing a pen-shape housing and an application device with a nib which is held by the pen-shaped housing. The Sandbach device further provides that application device contains a fabric treatment composition comprises at least one bleach and at least one surfactant used for application on fresh stains. However, the Casey device does not provide a pointed tip brush applicator nor is it configured to apply liquid dye to substantially cover bleach marks on garments of clothing.

Similarly, U.S. Pat. No. 6,283,933 to D'Alessio is a disposable applicator that provides a generally tubular applicator body having a closed proximal end and an open distal end and a vial therein. The proximal end is covered with a drying swab and the open distal end is covered by an applicator swab that is in open communication with the interior of the applicator body. The vial therein contains biomedical useful liquid compositions, such as anti-bacterial agents. However, the Casey device does not provide a pointed tip brush applicator that is configured to apply liquid dye to substantially cover bleach spots on clothing.

U.S. Pat. No. 3,628,876 to Casey device provides a writing implement with a fluid reservoir. The Casey device includes a rod-like applicator that is in communication with the fluid reservoir and a means to fixating the applicator from normal writing pressure. The applicator includes a synthetic polymer matrix having a plurality of interconnected voids to permit capillary movement of a writing fluid therethrough upon contact of the point with the writing surface. However, the Casey device does not provide a pointed tip brush applicator that is configured to apply liquid dye to substantially cover bleach spots on clothing.

U.S. Published Patent Application 2012/0257921 to Diener discloses a liquid fluid applicator device with an applicator head, a tubular container body and fluid therein. The applicator head is a removably attached piece from the tubular container body. The fluid in the container body is dispensed towards the applicator head in a predetermined dose and the applicator head can be removed completely from the container body to be used independently. The applicator head further includes a distributor body consisting of a bristle brush, sponge, textile, and extruded plastic. However, the Casey device does not provide pointed tip brush applicator configured to disperse the liquid dye when placed in contact with a bleach spot on a garment of clothing.

U.S. Pat. No. 5,324,127 to Cortez provides a shoe polish applicator dressing the edges and heels of shoe soles which includes a roller saturated with a fluid dressing agent. The roller has felt rotatably mounted on a shaft. The Cortez device further discloses a handle, a liquid impervious detachably attached cap to the handle, and a pad secured within the cap infused with the fluid dressing agent. The fluid dress agent is transferred to the felt on roller by compression of the roller on the cap. The fluid dressing agent is available for application when cap is detached from the handle. However, the Casey device does not provide pointed tip brush applicator configured to disperse the liquid dye when placed in contact with a bleach spot on a garment of clothing.

Finally, U.S. Published Patent Application Number 2002/0178511 to Goldini provides a device for spot cleaning a fabric with a liquid cleaning composition. The Goldini discloses a tubular member, a reservoir for holding the composition, and an applicator for applying the composition. The Goldini device further discloses an absorbent means for absorbing at least some of the composition on the fabric. However, the Casey device does not provide a pointed tip brush applicator configured to disperse the liquid dye when placed in contact with a bleach spot on a garment of clothing.

The devices disclosed in the prior art have several known drawbacks. Some of these devices provide a tubular applicator body with a vial therein in communication with the open end of the tubular applicator body. Other devices disclose a removably attached applicator head, a tubular container body and fluid therein, wherein the applicator head further includes a distribution body such as brush bristles. These devices, however, are limited in that the foregoing devices do not provide a pointed brush tip applicator configured to apply liquid dye to faded, stained, or bleached garments and fabrics.

The garment dye pen comprises a tubular housing having a closed distal end and an open proximal end forming a fluid reservoir therein containing liquid dye. The open proximal end includes female threaded elements that align with a cap having aligning male threaded elements. The liquid dye is induced to evacuate the fluid reservoir through a nozzle on the cap. The cap further comprises a pointed tip brush applicator also configured to disperse the liquid dye when placed in contact with a bleach spot on a garment of clothing. It is therefore submitted that the present invention is substantially divergent in design elements from the prior art, and consequently it is clear that there is a need in the art for an improvement to garment dye pen. In this regard, the instant invention substantially fulfills these needs.

SUMMARY OF THE INVENTION

In view of the foregoing disadvantages inherent in the known types of fabric treatment applications now present in the prior art, the present invention provides a new and improved garment dye pen that is adapted to be placed in contact with a bleach spot thereon a garment of clothing and deliver the dye to the surface of the garment.

It is therefore an object of the invention to provide a new and improved garment dye pen that has all of the advantages of the prior art and none of the disadvantages.

Another object of the present invention is to provide a new and improved garment dye pen to provide an applicator for garment dye, which allows for substantial covering of relatively isolated bleached spots, faded or stained garments and fabrics.

Yet another object of the present invention is to provide a new and improved garment dye pen comprising tubular housing having a closed distal end and an open proximal end forming a fluid reservoir therein containing liquid dye.

Still yet another object of the present invention is to provide a new and improved garment dye pen, wherein the open proximal end further comprises a cap having a nozzle and a pointed tip brush applicator.

Another object of the present invention is to provide a new and improved garment dye pen, wherein said pointed tip brush applicator is configured to disperse the liquid dye when placed in contact with a bleach spot on a garment of clothing.

A further object of the present invention is to provide a new and improved garment dye pen, wherein the liquid dye includes a plurality of colors configured to substantially match many different colors of clothing.

Another object of the present invention is to provide a new and improved garment dye pen which is easy to use and portable.

Still yet another object of the present invention is to provide a new and improved garment dye pen wherein the device may be readily fabricated from materials that permit relative economy and are commensurate with durability.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein the numeral annotations are provided throughout.

DETAILED DESCRIPTION OF THE INVENTION

Figure 1:
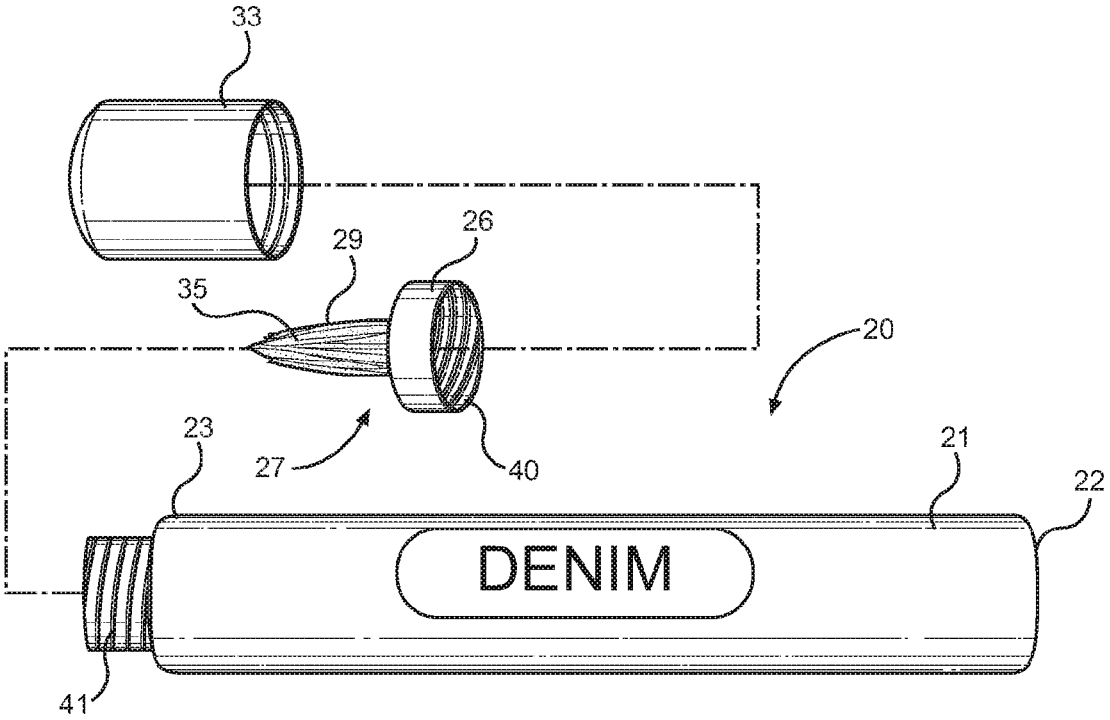
FIG. 1 shows a side perspective of the present invention.

References are made herein to the attached drawings. Like reference numerals are used throughout the drawings to depict like or similar elements of the garment dye pen. For the purposes of presenting a brief and clear description of the present invention, the preferred embodiment will be discussed as applied thereon a pair of jeans. The figures are intended for representative purposes only and should not be considered to be limiting in any respect.

Referring now to FIG. 1, there is shown a side perspective of the preferred embodiment of the garment dye pen 20. The garment dye pen 20 comprises a tubular housing 21 is substantially cylindrical and pen-shaped having a closed distal end 22 and an open proximal end 23 forming a fluid reservoir therein. Liquid dye is filled within the fluid reservoir, wherein the liquid dye preferably includes a multitude of colors that are able to substantially match the color of a garment of clothing. The liquid dye is preferably a fiber reactive dye, however, without limitation, other embodiments include other suitable types of liquid dyes such as protein-based dyes and acid dyes.

The open proximal end 23 further comprises female threaded elements 40, wherein a cap 27 with aligning male threaded elements 41 is removably secured to the open proximal end 23. The cap 27 includes a circular portion having an outer edge, wherein a sidewall extends perpendicularly therefrom. The circular portion includes a pointed tip brush applicator 29 that is in liquid communication with the fluid reservoir within the tubular housing 21. The pointed tip brush applicator 29 is centrally positioned on the circular portion and configured to be placed in contact with a bleach spot on a garment of clothing to disperse the liquid dye thereon for substantially cover the bleach spot thereon.

The pointed tip brush applicator 29 includes a plurality of brush bristles 35. Preferably, the brush bristles are composed of polyethylene, however, without limitation, other embodiments are alternative composed of other suitable plastic polymers or metal. The pointed tip brush applicator 29 is substantially cone-shaped which enables the garment dye pen 20 to transfer liquid dye to a very restricted and selected area. Therefore, the pointed tip brush applicator 29 is configured to prevent overbroad covering of bleach marks thereon and the waste of liquid dye.

Figure 4:
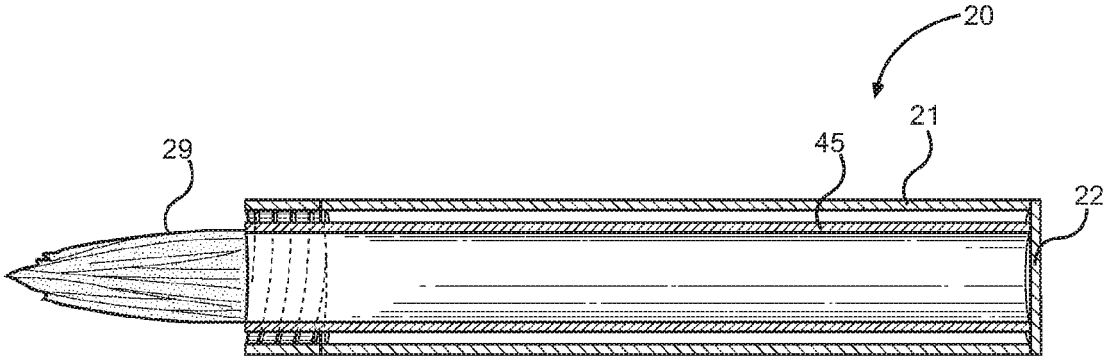
FIG. 4 shows a cross-sectional view of the present invention.

In the illustrated embodiment of FIG. 4, the fluid reservoir within the housing 21 further comprises an interior chamber 45. The interior chamber 45 is substantially shaped and sized to match the fluid reservoir within the housing 21, however the interior chamber 45 is designed to provide an extra layer of protection in the case the housing 21 is cracked and damaged allowing liquid dye from within the fluid reservoir to spill out. In this way, the interior chamber 45 is particularly advantageous in potential leaking of liquid dye from the fluid reservoir and storing the liquid dye within the fluid reservoir. Preferably, the housing 21 and the interior chamber 45 are composed of a thermoset or thermoplastic material, such as polypropylene plastic, however, without limitation, other embodiments are alternatives composed of other appropriate resilient plastics.

The garment dye pen 20 further includes a lid 33 that is substantially cylindrical in shape and adapted to removably secure to the cap 27 and prevent any leaking of liquid dye through the pointed tip applicator 29. The lid 33 includes a round portion having an outer perimeter, wherein a circular wall extends perpendicularly along the outer perimeter. The round portion and circular wall form an interior volume that is configured to receive the pointed tip applicator 29 and cap 27. Preferably, the lid 33 is removably attached by a friction fit, however, other embodiments may include fasteners.

Figure 2:
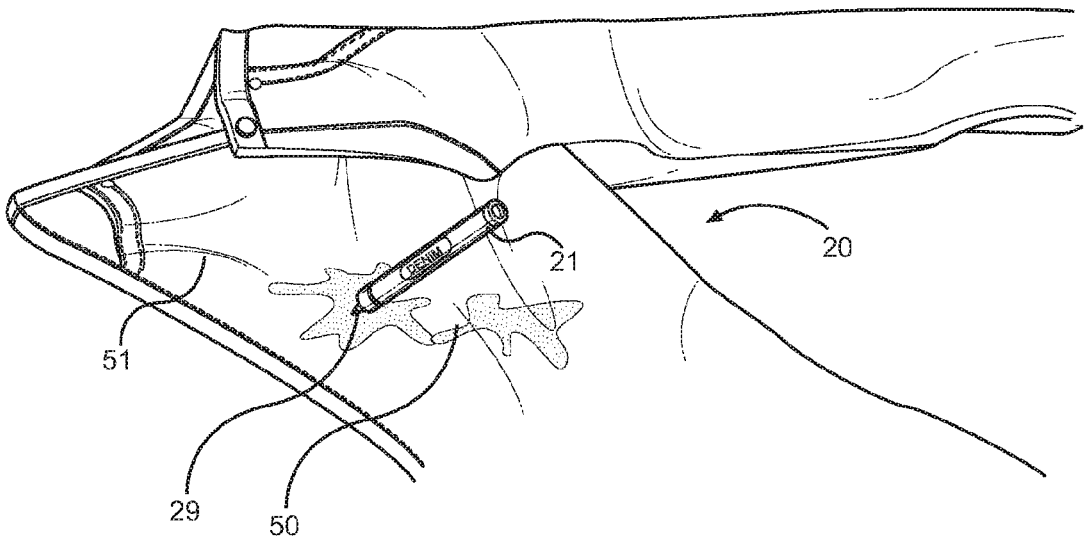
FIG. 2 shows an overhead perspective of the present invention placed in contact with a pair of jeans to apply liquid dye to a bleach spot thereon.

Referring now to FIG. 2, there is shown an overhead view of the garment dye pen 20 in operation. The garment dye pen 20 comprises a tubular housing 21 having a closed distal end 22 and an open proximal end 23 forming a fluid reservoir therein containing liquid dye. The open proximal end 23 includes a cap 27 that is removably secured through male and female threaded elements. The liquid dye is induced to evacuate the fluid reservoir through a nozzle 26 on the cap 27. The cap 27 further comprises a pointed tip brush applicator 29 also configured to disperse the liquid dye when placed in contact with a bleach spot 51 on a pair of jeans 50. Generally, a pair of jeans 50 are a navy color, however the bleach spot 51 would take the color out from a particular area. The pointed tip brush applicator 29 can be pressed into contact with the bleach spot 51, which disperses the liquid dye over the entirety of the bleach spot 51 thereon. In this way, the garment dye pen 20 is particularly advantageous as the application of similarly colored liquid dye over the bleach spot 51 can conceal the bleach spot 51.

The garment dye pen 20 can be held as if the garment dye pen 20 was a pen, pencil, or marker. After application of the liquid dye thereon, the pair of jeans 51 generally should be given time to dry to allow the liquid dye to react with the fibers of the pair of jeans 51. Depending on the liquid dye and timeframe, the liquid dye can be left to dry overnight or according to a specified timeframe. The pair of jeans 51 can then be rinsed out with water to remove the excess dye. In this manner, the garment dye pen is particularly advantageous as the pair of jeans 51 does not have to be washed and treated in a special manner afterwards, wherein any standard washing with similar colors will suffice and the bleach spot 50 thereon will remain covered with liquid dye.

Figure 3:
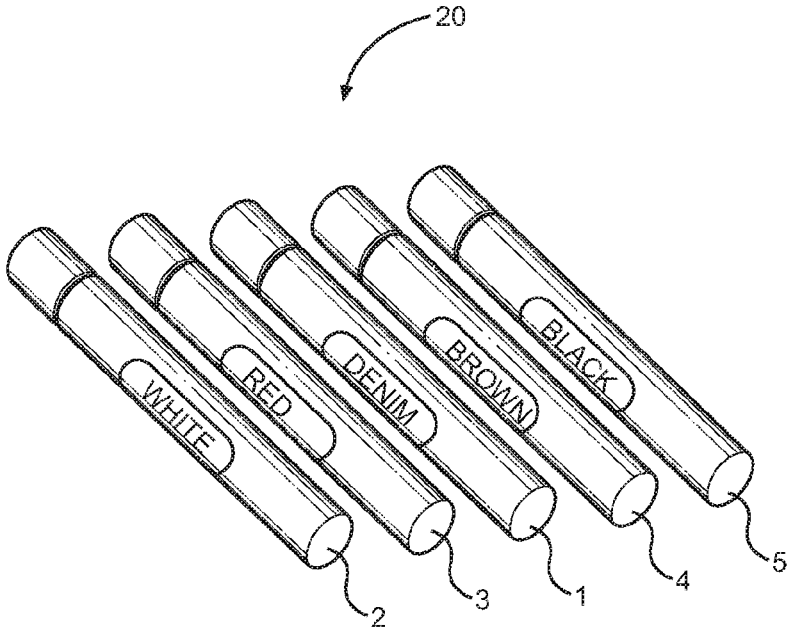
FIG. 3 shows an overhead perspective of several other preferred embodiments of the present invention.

Referring now to FIG. 3, there are shown an overhead perspective of several other preferred embodiments of the garment dye pen 20 including the foregoing preferred embodiment described in FIGS. 1 and 2. The preferred embodiment 1 is the aforementioned embodiment with the navy-colored liquid dye. The other preferred embodiments 2, 3, 4, 5 include white liquid dye, red liquid dye, brown liquid dye, and black liquid dye, respectively, within its fluid reservoirs. Embodiments 1, 2, 3, 4, 5 are configured to be applied to similarly-colored garments of clothing or fabric, wherein the garment has a relatively isolated discolored mark, such as a bleach mark, a stain, or a faded spot. A user can substantially cover the relatively isolated discolored marks with a substantially similar liquid dye allowing the discoloration to be relatively unnoticeable. Therefore, in this way, a user can wear or use the garments and fabrics again.

According to the preferred embodiment, the garment dye pen further provides a method of covering relatively isolated discolored marks such as bleach marks, stains, or faded spots, on garments of clothing or other types of fabrics, comprising the steps of:

selecting a garment dye pen comprising a tubular housing having a closed distal end and an open proximal end forming a fluid reservoir therein containing liquid dye of similar color to a garment of clothing;

placing a pointed tip brush applicator on a cap, which is removably fastened to the open proximal end, in contact with a bleach spot on the garment of clothing, wherein said pointed tip brush applicator comprises a plurality of brush bristles forming substantially a cone-shape and said liquid dye is induced to evacuate said fluid reservoir through a nozzle on the cap to said pointed tip brush applicator;

dispersing said liquid dye through the pointed tip brush applicator when placed in contact with said bleach spot on the garment of clothing and covering said bleach spot with said liquid dye.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above descriptions then, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specifications are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A garment dye pen for covering relatively isolated discolored marks, such as bleach marks, stains, or faded spots, on garments of clothing or other types of fabrics, comprising:

a tubular housing having a closed distal end, an open proximal end forming a fluid reservoir filled with liquid dye therein;

said fluid reservoir comprising an interior chamber conforming to the shape of said tubular housing;

a cap comprising a nozzle and an applicator extending from said nozzle;

wherein said cap further comprises a female threaded element aligned with a male threaded element disposed on said open proximal end and configured to removably secure said open proximal end to said cap;

wherein said nozzle is in liquid communication with said fluid reservoir and said applicator;

wherein said applicator includes a pointed brush tip comprising a plurality of brush bristles that form a cone-shape;

wherein said applicator is configured to dispense said liquid dye.

2. The garment dye pen for covering relatively isolated discolored marks, such as bleach marks, stains, or faded spots, on garments of clothing or other types of fabrics of claim 1, wherein said tubular housing is substantially cylindrical and pen-shaped.

3. The garment dye pen for covering relatively isolated discolored marks, such as bleach marks, stains, or faded spots, on garments of clothing or other types of fabrics of claim 1, further comprising a lid configured to enclose said cap by friction fit.

4. The garment dye pen for covering relatively isolated discolored marks, such as bleach marks, stains, or faded spots, on garments of clothing or other types of fabrics of claim 1, wherein said liquid dye is composed of a variety of colors of dye;

Said liquid dye is configured to substantially match the color of the garment of clothing and cover the bleach mark thereon.

5. The garment dye pen for covering relatively isolated discolored marks, such as bleach marks, stains, or faded spots, on garments of clothing or other types of fabrics of claim 1, wherein an exterior surface of said tubular housing between said closed distal end and said open proximal end is void of an opening.

6. A method of covering relatively isolated discolored marks, such as bleach marks, stains, or faded spots, on garments of clothing or other types of fabrics, comprising the steps of:

selecting a garment dye pen comprising a tubular housing having a closed distal end and an open proximal end forming a fluid reservoir therein containing liquid dye of similar color to a garment of clothing, wherein the fluid reservoir comprises an interior chamber conforming to the shape of the fluid reservoir;

placing a pointed tip brush applicator of a cap, which is removably fastened to the open proximal end, in contact with a bleach spot on a garment of clothing, wherein said pointed tip brush applicator comprises a plurality of brush bristles forming a cone-shape and said liquid dye is induced to evacuate said fluid reservoir through a nozzle on the cap to said pointed tip brush applicator;

dispersing said liquid dye through the pointed tip brush applicator when placed in contact with said bleach spot on the garment of clothing and covering said bleach spot with said liquid dye;

refilling said tubular housing with additional dye by inserting said additional liquid dye through said open proximal end.

* * * * *